US007340931B1

(12) United States Patent
Chuang

(10) Patent No.: US 7,340,931 B1
(45) Date of Patent: Mar. 11, 2008

(54) ROLL FORMING AND PUNCHING MACHINE FOR METAL SHEET MATERIAL

(76) Inventor: Sen-Jung Chuang, No. 90-10, Hsia Kwei Jou San, Tan Shui Chen, Taipei County (TW)

( * ) Notice: Subject to any disclaimer, the term of this patent is extended or adjusted under 35 U.S.C. 154(b) by 90 days.

(21) Appl. No.: 11/291,842

(22) Filed: Dec. 2, 2005

(51) Int. Cl.
*B21D 43/28* (2006.01)

(52) U.S. Cl. ..... 72/132; 72/181; 83/328

(58) Field of Classification Search ..... 72/129, 72/132, 181, 185, 186, 196; 83/328
See application file for complete search history.

(56) References Cited

U.S. PATENT DOCUMENTS 2,406,808 A * 9/1946 Conner ..... 83/129
3,264,920 A * 8/1966 Hallden ..... 83/311
3,296,910 A * 1/1967 Haskin, Jr. et al. ..... 83/328
3,861,260 A * 1/1975 Kesten et al. ..... 83/328
4,420,998 A * 12/1983 Tokuno et al. ..... 83/328
4,471,641 A * 9/1984 Mitchell ..... 72/132
4,485,713 A * 12/1984 Dotta ..... 83/543

* cited by examiner

*Primary Examiner*—Daniel C Crane
(74) *Attorney, Agent, or Firm*—Troxell Law Office, PLLC

(57) ABSTRACT

A punching machine installed in the machine base of a roller shape forming machine in a metal working system and controlled to punch holes on a metal sheet material being delivered through the roller shape forming machine during operation of the roller shape forming machine. The punching action, i.e., the cycling of the closing and opening actions of the punch mold of the punching machine is set to match with the delivering speed of the metal sheet material in the roller shape forming machine so that the punching operation of the punching machine is continued during processing operation of the roller shape forming machine.

2 Claims, 10 Drawing Sheets

ROLL FORMING AND PUNCHING MACHINE FOR METAL SHEET MATERIAL

BACKGROUND AND SUMMARY OF THE INVENTION

The present invention relates to a punching machine and more particularly, to such a punching machine, which is installed in the machine base of a roller shape forming machine in a metal working system and controlled to punch holes on a metal sheet material being delivered through the roller shape forming machine during operation of the roller shape forming machine.

In a metal working system, as shown in FIG. 1, metal sheet material 90 is fed to a hydraulic punch 91 and punched by the hydraulic punch 91 to have holes at desired locations, and then the punched metal sheet material 90 is carried by a material feeder 92 to a roller shape forming machine 93 and rammed into the desired shape. This metal working system is still not satisfactory in function because of the following drawbacks:

1. Because the processing speed of the hydraulic punch 91 is relatively slower and the feeding speed of the material feeder 92 is relatively faster, a sensor must be installed in between the hydraulic punch 91 and the material feeder 92 to control the operation of the roller shape forming machine 93 subject to the punching speed of the hydraulic punch 91. This operation procedure is complicated, lowering the manufacturing speed.
2. The hydraulic punch 91 and the material feeder 92 are heavy and expensive, requiring much floor space.

The present invention has been accomplished under the circumstances in view. According to one aspect of the present invention, the punching machine is installed in the machine base of a roller shape forming machine in a metal working system and controlled to punch holes on a metal sheet material being delivered through the roller shape forming machine during operation of the roller shape forming machine. The punching action, i.e., the cycling of the closing and opening actions of the punch mold of the punching machine is set to match with the delivering speed of the metal sheet material in the roller shape forming machine so that the punching operation of the punching machine is continued during processing operation of the roller shape forming machine. According to another aspect of the present invention, the punch mold of the punching machine comprises an upper mold holder, which holds a number of upper punching dies, and a lower mold holder, which holds a number of bottom punching dies corresponding to the upper punching dies. The number of the upper punching dies and the bottom punching dies can be adjusted subject to the number of holes to be punched on the metal sheet material being delivered through the roller shape forming machine.

DETAILED DESCRIPTION OF THE INVENTION

Figure 10:
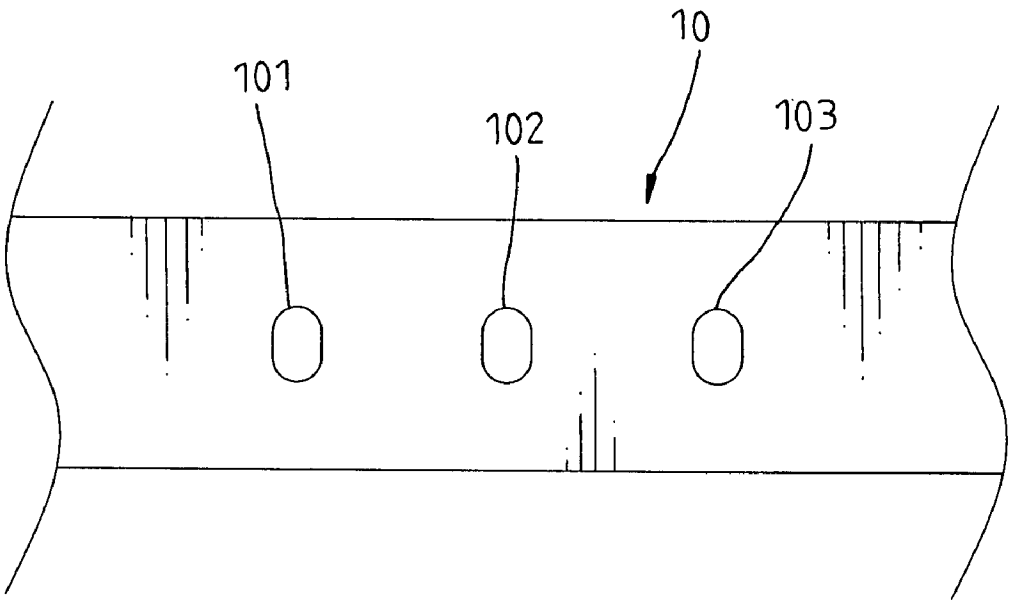
FIG. 10 is a schematic plain view of a metal sheet material after punching through the punching machine of the present invention.

Referring to FIGS. 2~9, a punching machine is installed in a metal working system above a roller shape forming machine (not shown), and controlled to punch holes on the metal sheet material 10 fed therein (see FIG. 10), for enabling the punched metal sheet material 10 to be further fed to the roller shape forming machine for roller-ramming into a predetermined shape.

Figure 1:
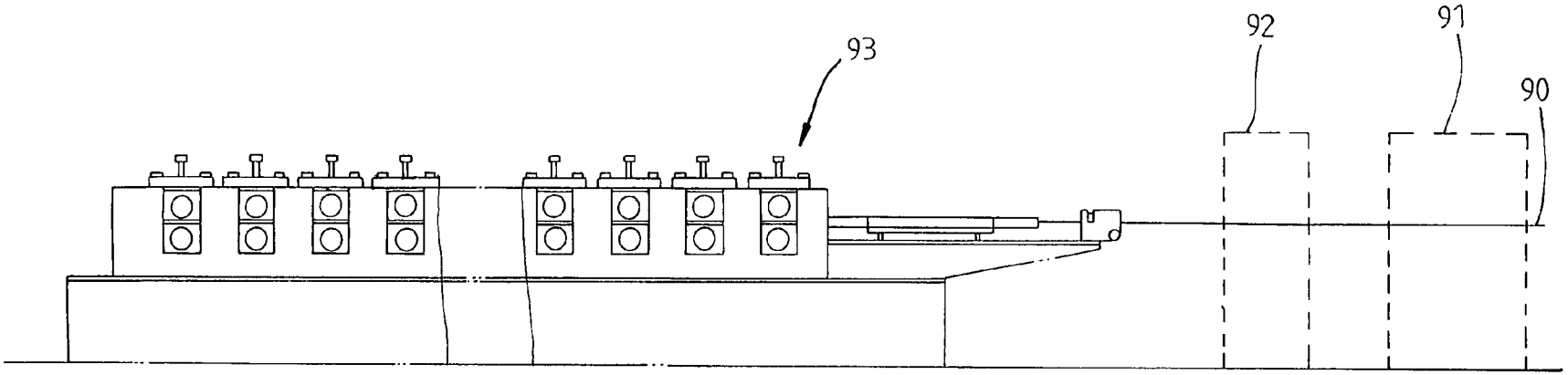
Fig. 1 PRIOR ART
FIG. 1 is a schematic plain view showing the arrangement of a hydraulic punch, a material feeder and a roller shape forming machine in a metal working system according to the prior art.
Figure 2:
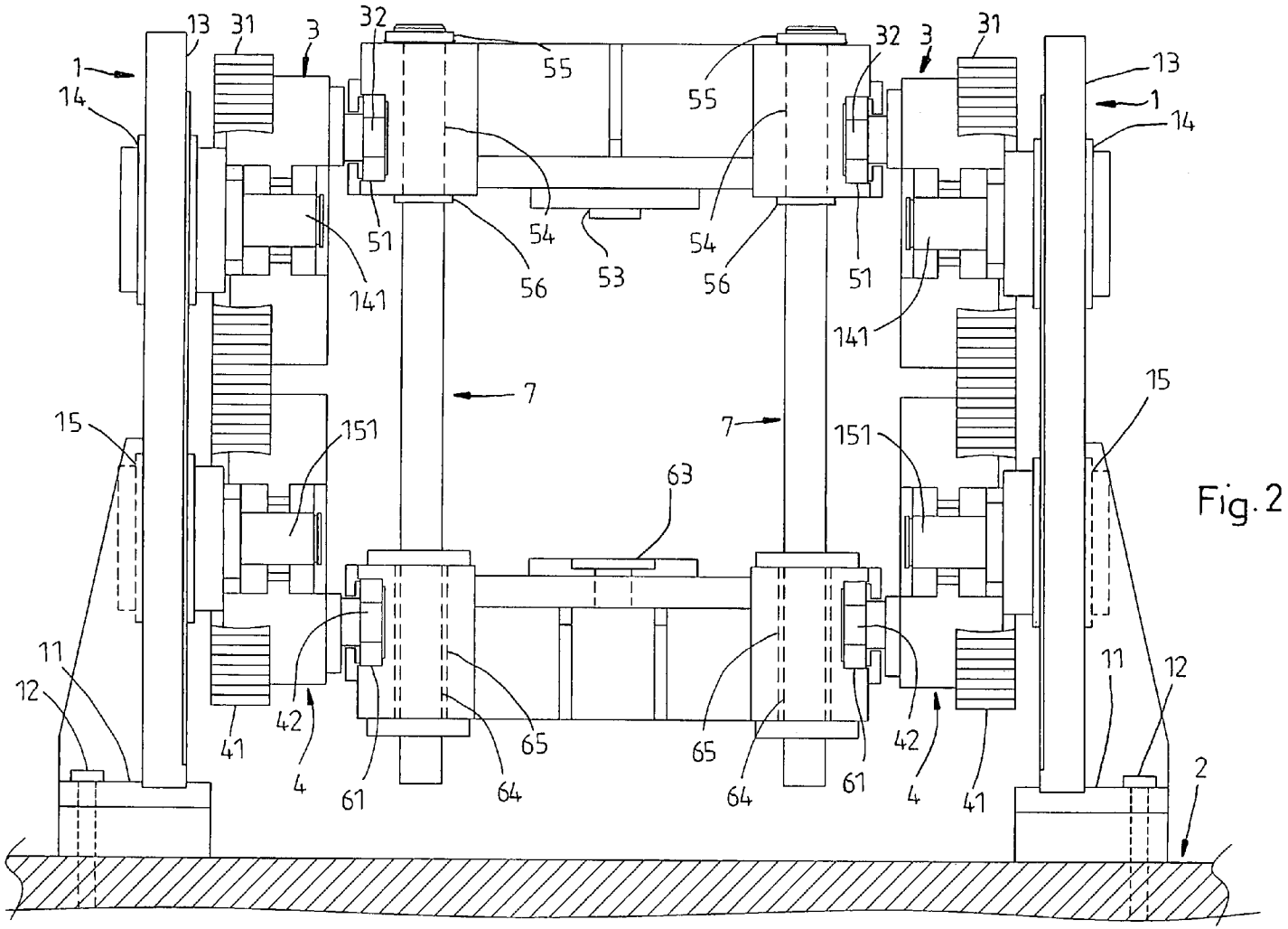
FIG. 2 is a schematic front plain view of a punching machine according to the present invention, showing the upper mold holder and the lower mold holder fully opened.
Figure 3:
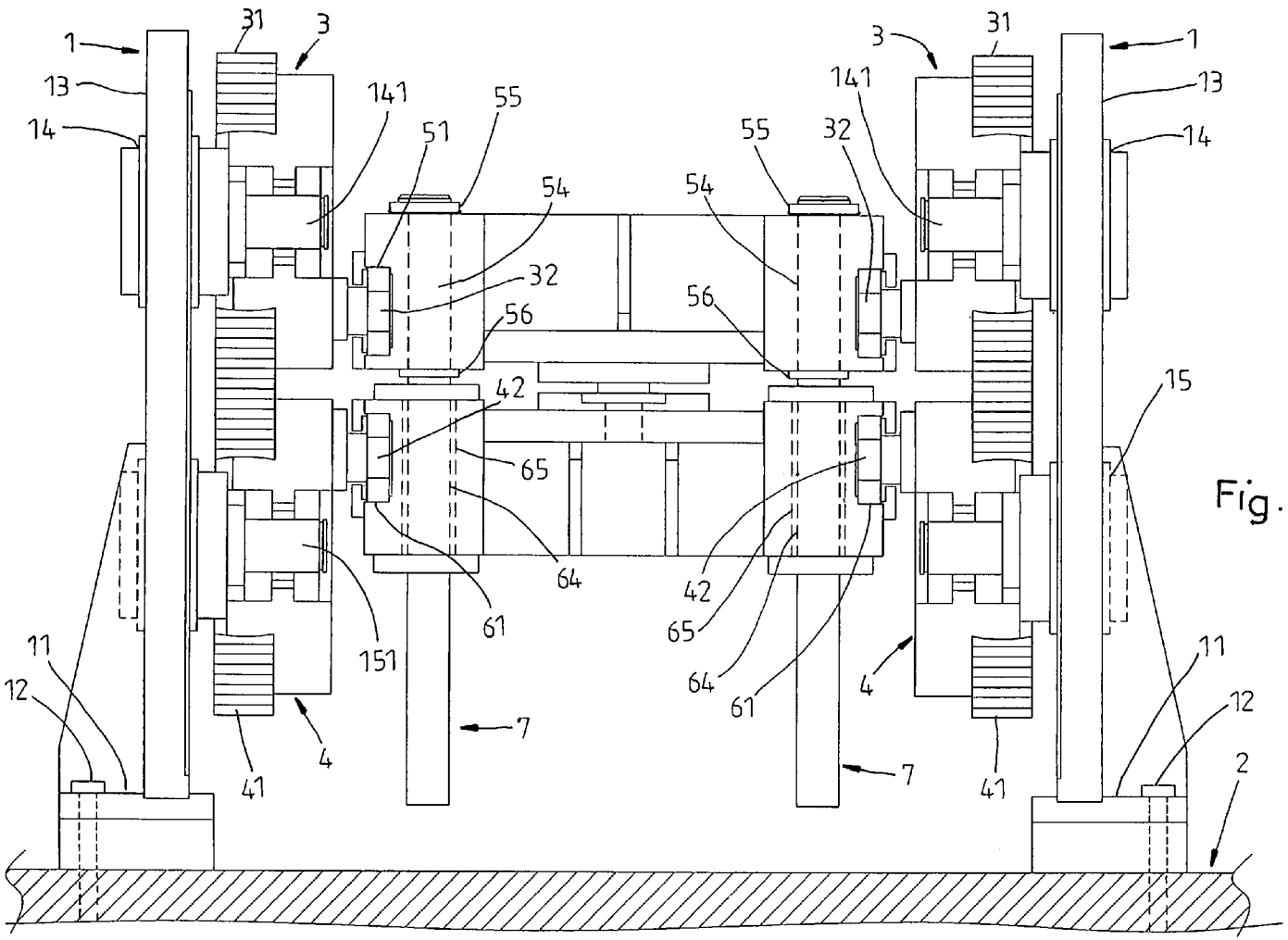
FIG. 3 is another schematic front plain view of the punching machine according to the present invention, showing the upper mold holder and the lower mold holder closed.
Figure 4:
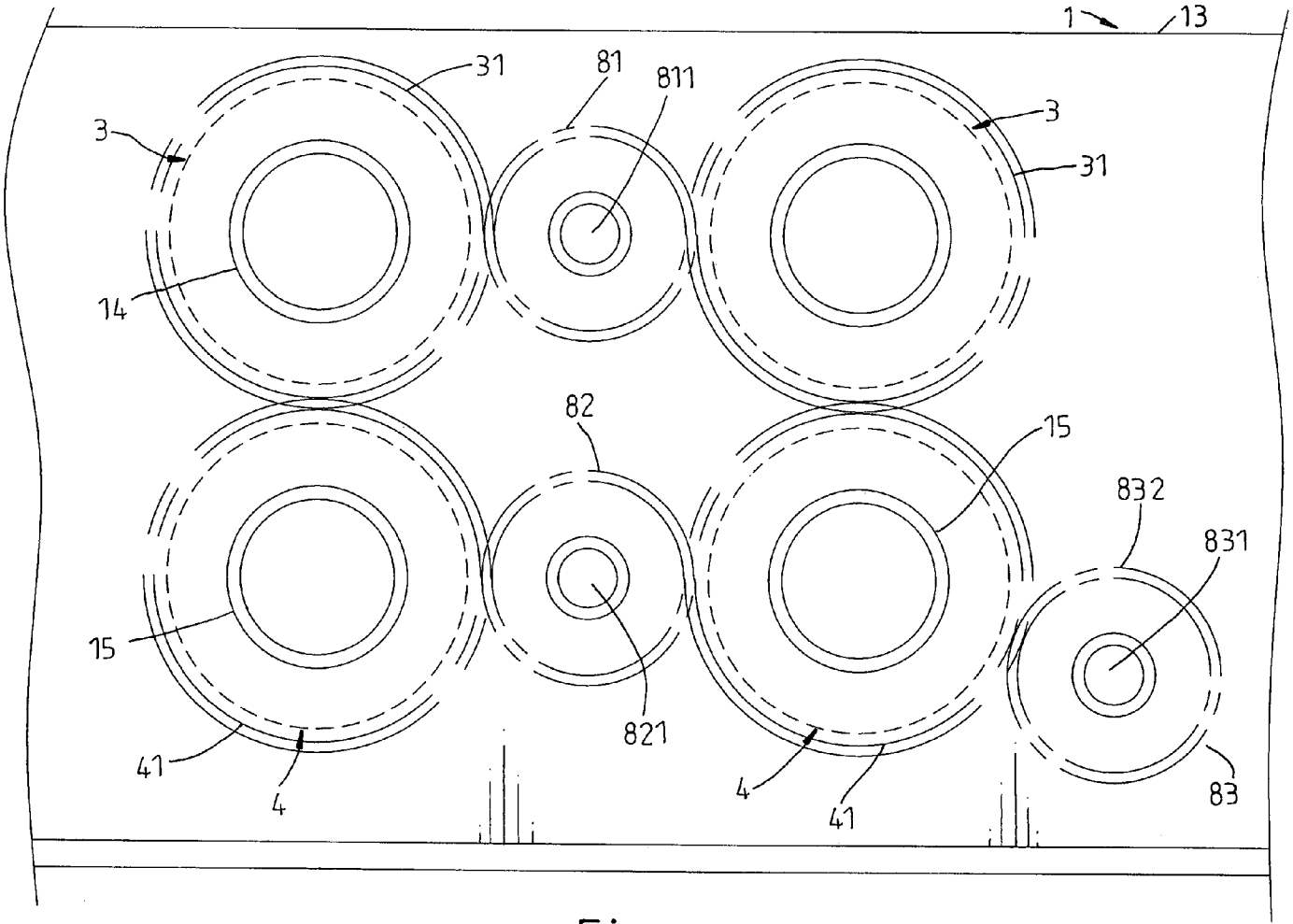
FIG. 4 is a schematic side plain view of a part of the punching machine according to the present invention.

The punching machine comprises:

Two locating frames 1 arranged in parallel on the top side of the machine base 2 of the roller shape forming machine, each locating frame 1 comprising a bottom mounting block 11 fixedly fastened to the machine base 2 of the roller shape forming machine with fasteners 12, a vertical wall 13 upwardly extending from the bottom mounting block 11 to a predetermined height, two upper supports 14 and two lower supports 15 arranged on the vertical wall 13 at different elevations (see FIG. 4), two first shafts 141 respectively horizontally provided at the upper supports 14, and two second shafts 151 respectively horizontally provided at the lower supports 15;

an upper mold holder 5 holding a plurality of upper punching dies 53, the upper mold holder 5 having two horizontal coupling holes 51 and two vertical axle holes 54;

a lower mold holder 6 holding a plurality of bottom punching dies 63, the lower mold holder 6 having two horizontal coupling holes 61 and two vertical axle holes 64;

four first bearing blocks 3 respectively pivotally mounted on the first shafts 141 at the upper supports 14, each first bearing block 3 having an eccentric rod 32 respectively pivotally coupled to the horizontal coupling holes 51 of the upper mold holder 5;

four first transmission gears 31 respectively fixedly mounted around the periphery of the first bearing blocks 3;

four second bearing blocks 4 respectively pivotally mounted on the second shafts 151 at the lower supports 15, each second bearing block 4 having an eccentric rod 42 respectively pivotally coupled to the horizontal coupling holes 61 of the lower mold holder 6;

four second transmission gears 41 respectively fixedly mounted around the periphery of the second bearing blocks 4 and respectively meshed with the first transmission gears 31;

two guide axles 7 respectively inserted through the vertical axle holes 54 of the upper mold holder 5 and the vertical axle holes 64 of the lower mold holder 6;

a plurality of fastening members 55 and 56 respectively fastened to the guide axles 7 at top and bottom sides of the vertical axle holes 54 to affix the guide axles 7 to the upper mold holder 5;

two axle bearings 65 respectively mounted in the vertical axle holes 64 of the lower mold holder 6 to support the guide axles 7 in the vertical axle holes 64 of the lower mold holder 6;

two first driven gears 81 respectively meshed between the first transmission gears 31 at the first bearing blocks 3 at the vertical walls 13 of the locating frames 1, each first driven gear 81 having a gear shaft 811 respectively pivotally mounted on the vertical walls 13 of the locating frames 1 (see FIG. 4);

two second driven gears 82 respectively meshed between the second transmission gears 41 at the second bearing blocks 4 at the vertical walls 13 of the locating frames 1, each second driven gear 82 having a gear shaft 821 respectively pivotally mounted on the vertical walls 13 of the locating frames 1 (see FIG. 4);

a drive gear set 83, the drive gear set 83 comprising a gear shaft 831 pivotally supported between the vertical walls 13 of the locating frames 1, two drive gears 832 respectively fixedly mounted on the gear shaft 831 and respectively meshed with the second transmission gears 41 at the second bearing blocks 4 at the vertical wall 13 of one locating frame 1; and a motor 80, the motor 80 having an output shaft 833 coupled to the gear shaft 831 of the drive gear set 83.

Figure 5:
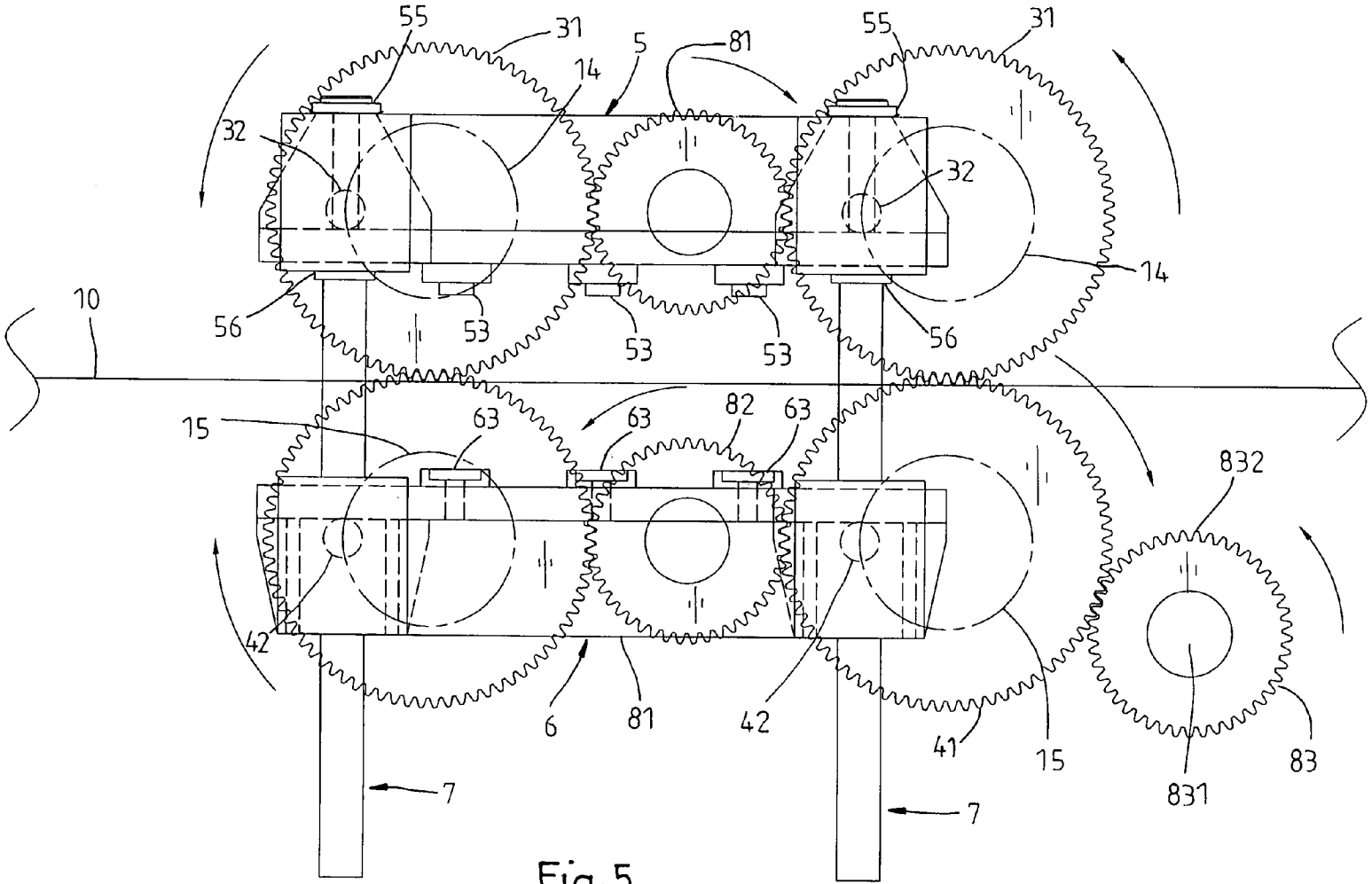
FIG. 5 is a schematic plain view showing the status of the mold-opening dead point of the punching machine according to the present invention.
Figure 6:
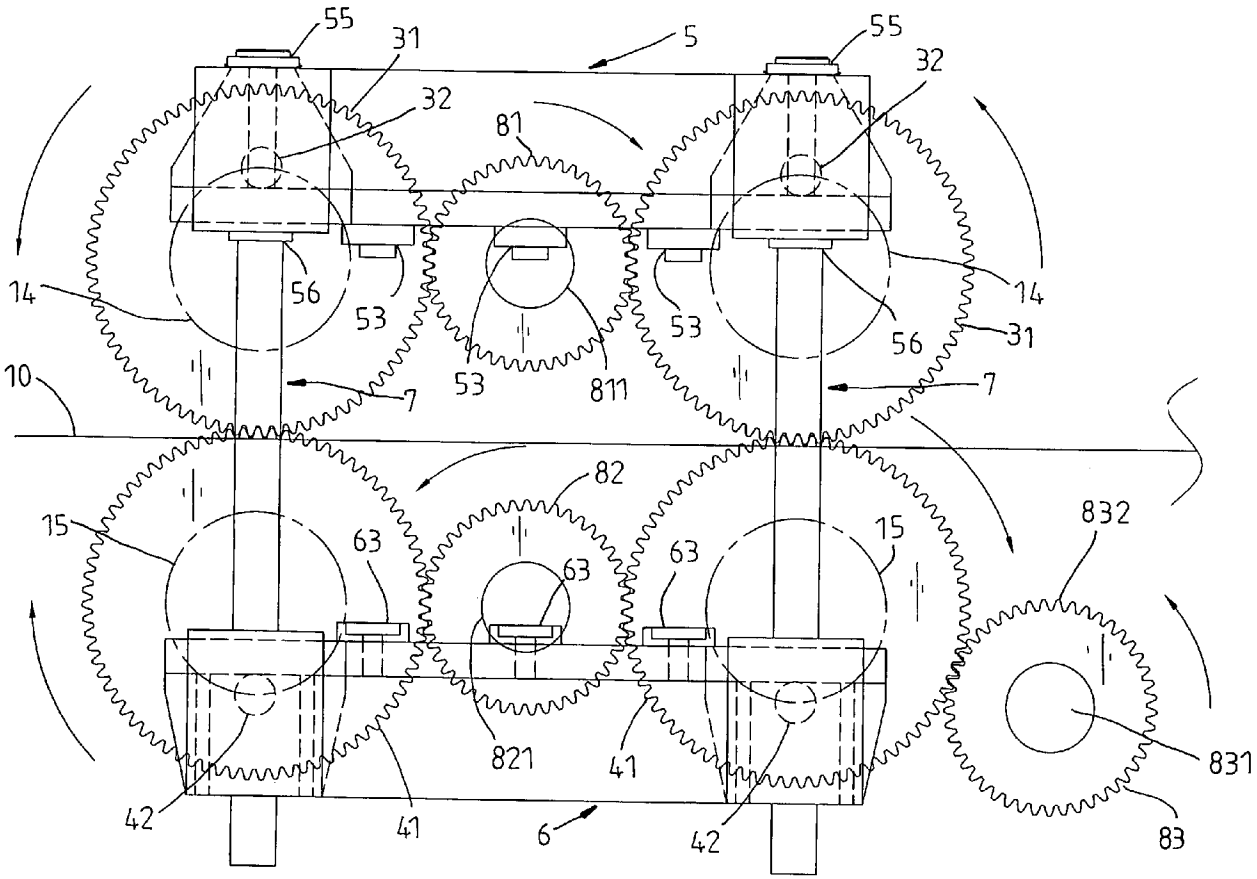
FIG. 6 is a schematic plain view showing the half way status of the punching machine during the mold-closing stroke according to the present invention.
Figure 7:
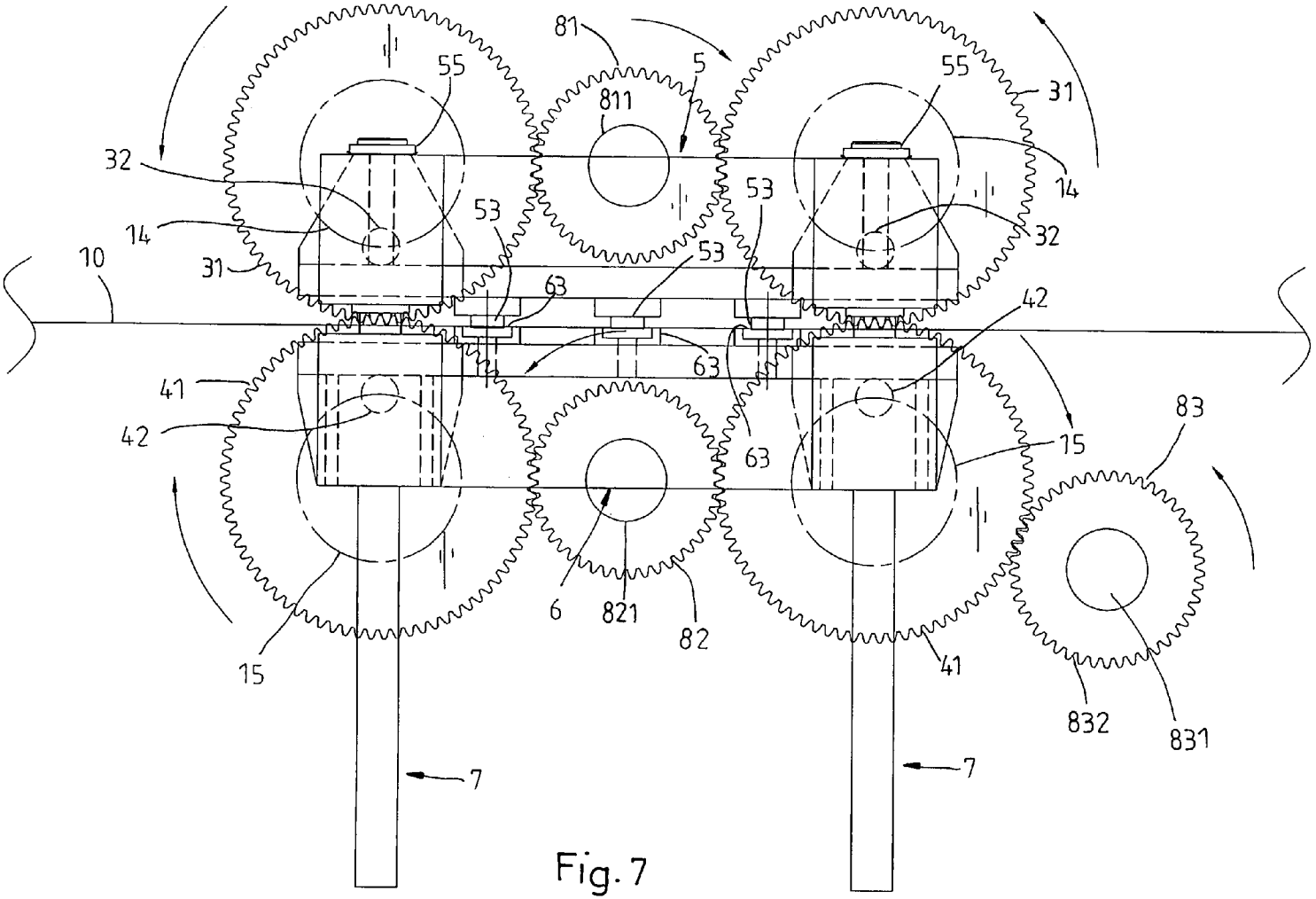
FIG. 7 is a schematic plain view showing the status of the mold-closing dead point of the punching machine according to the present invention
Figure 8:
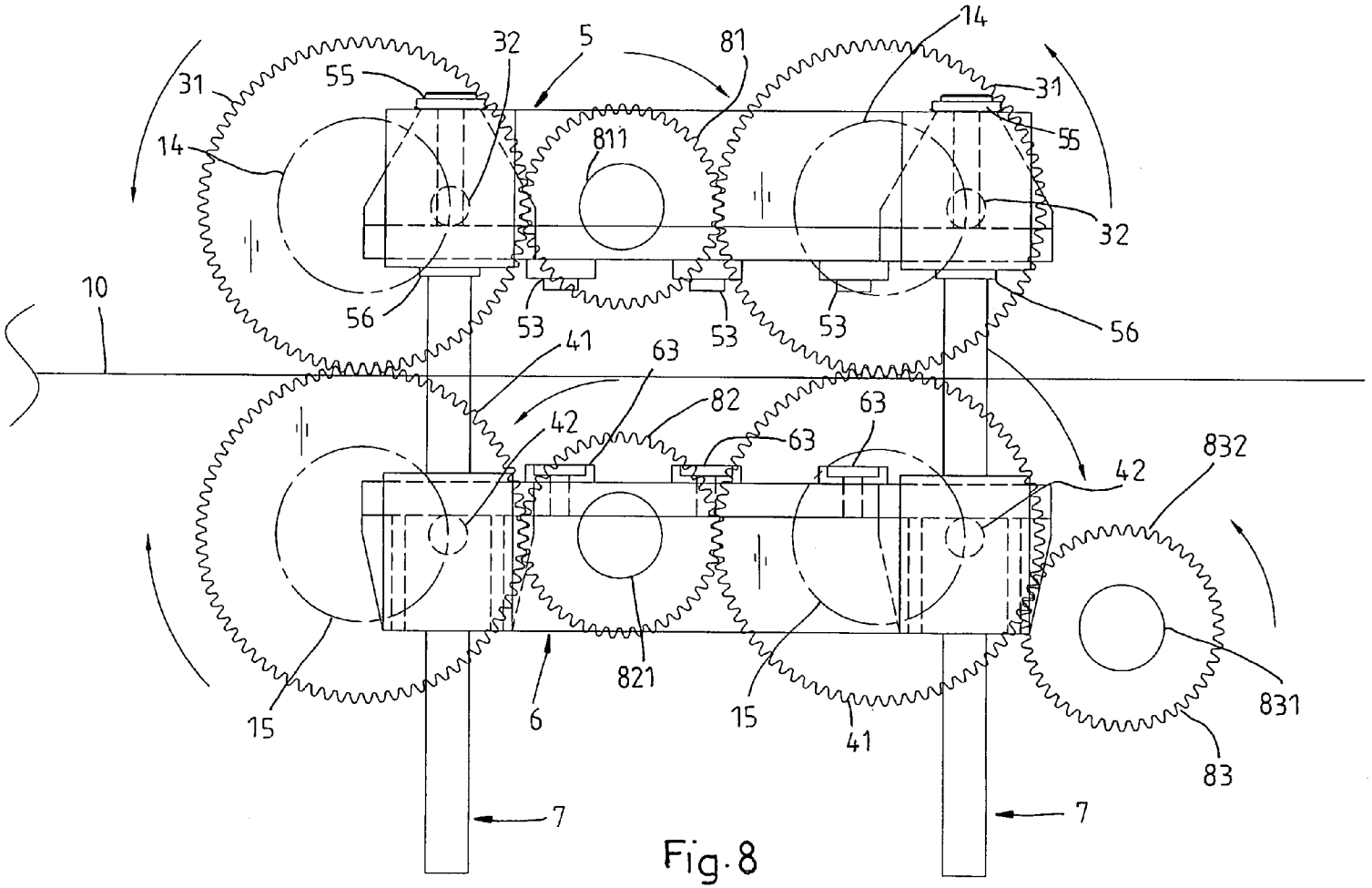
FIG. 8 is a schematic plain view showing the half way status of the punching machine during the mold-opening stroke according to the present invention.
Figure 9:
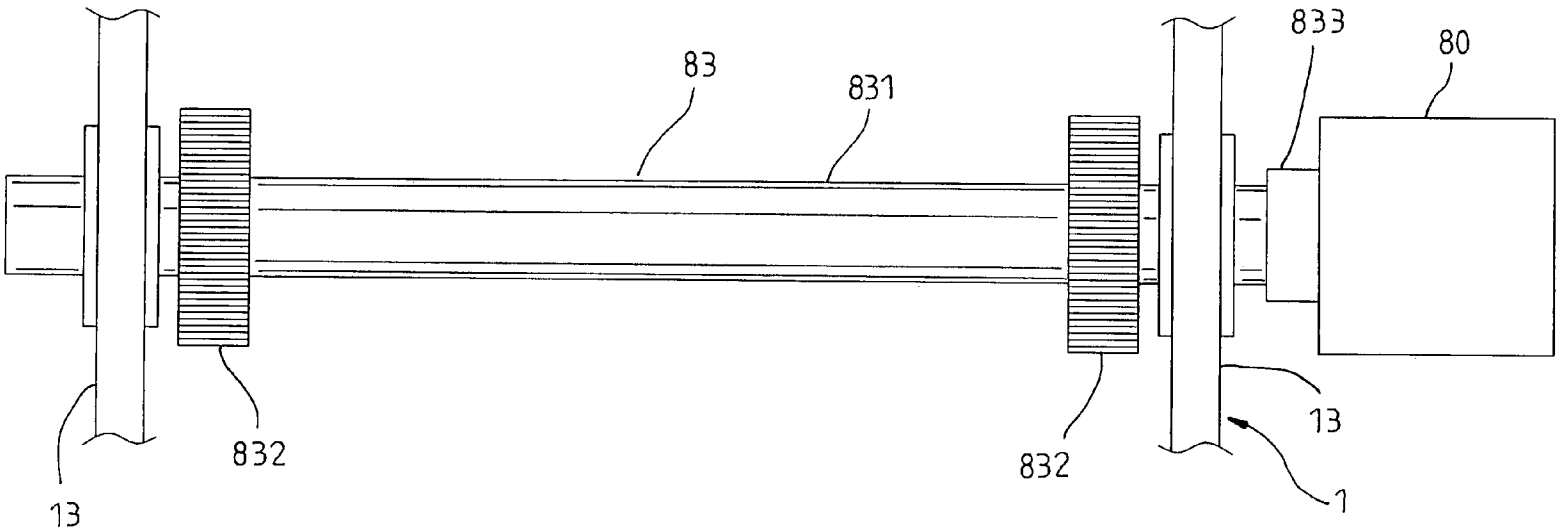
FIG. 9 is a schematic front plain view of a part of the punching machine according to the present invention, showing the structure of the drive gear set and the arrangement between the drive gear set and the motor.

When started the motor 80 to rotate the drive gears 832 of the drive gear set 83, the second transmission gears 41 are driven to rotate the second driven gears 82 and the first transmission gears 31 and then the first driven gears 81, thereby causing rotation of the first bearing blocks 3 and the second bearing blocks 4, and therefore the upper mold holder 5 and the lower mold holder 6 are respectively forced by the eccentric rods 32 of the first bearing blocks 3 and the eccentric rods 42 of the second bearing blocks 4 to move alternatively forwards and backwards relative to each other to punch the feeding metal sheet material 10 with the respective upper punching dies 53 and bottom punching dies 63. FIGS. 5~8 show one punching cycle of the punching machine. FIG. 5 is a schematic plain view showing the status of the mold-opening dead point (the punch mold is fully opened) of the punching machine. FIG. 6 is a schematic plain view showing the half way status of the punching machine during the mold-closing stroke. FIG. 7 is a schematic plain view showing the status of the mold-closing dead point (the punch mold is fully closed) of the punching machine. FIG. 8 is a schematic plain view showing the half way status of the punching machine during the mold-opening stroke.

Further, the punching machine is mounted on the front side of the top wall of the machine base 2 of the roller shape forming machine (not shown). When the metal sheet material 10 is being carried toward the rear side of the roller shape forming machine at a constant speed, the upper mold holder 5 and the lower mold holder 6 are continuously and alternatively moved relative to each other to punch the moving metal sheet material 10, and the roller shape forming machine is kept in operation.

Further, the cycling speed of the mold opening and closing actions of the mold holders 5 and 6 is set to match the feeding speed of the metal sheet material 10 in the roller shape forming machine, i.e., it is not necessary to shut down the roller shape forming machine when punching the feeding metal sheet material 10. Therefore, the invention saves much processing time of the metal working machine and greatly increases the manufacturing speed.

According to the present preferred embodiment, the revolving speed of the motor 80 is accurately controlled through an accurate calculation to match the metal sheet material feeding speed in the roller shape forming machine. However, other suitable transmission mechanisms may be selectively sued to substitute for the motor 80.

Further, according to this preferred embodiment, the upper mold holder 5 holds three upper punching dies 53, and the lower mold holder 6 holds three bottom punching dies 63 corresponding to the upper punching dies 53. Upon each punching cycle, three holes 101,102,103 are punched on the metal sheet material 10 (see FIG. 10). However, the number of the punching dies 53 and 63 may be adjusted subject to actual requirements.

As indicated above, the invention provides a punching machine for use with a roller shape forming machine in a metal working system, which has the following advantages:

1. The cycling of the closing and opening actions between the upper mold holder 5 and the lower mold holder 6 is set to match the metal sheet material 10 feeding speed in the roller shape forming machine so that the metal sheet material 10 is punched when the metal sheet material 10 is being delivered through the roller shape forming machine during the operation of the roller shape forming machine.

2. The upper mold holder 5 hold a plurality of upper punching dies 53 and the lower mold holder 6 hold an equal number of bottom punching dies 63 for punching a number of holes at predetermined locations upon each punching action. By means of adjusting the number of the punching dies 53 and 63, the number of holes to be punched on the metal sheet material is relatively adjusted.

What is claimed is:

1. A combined roller shape forming and punching machine controlled to punch holes on a metal sheet material being delivered through said roller shape forming machine during operation of said roller shape forming machine, comprising:

a roller shape forming machine having a series of rollers for shaping metal sheet material installed on a machine base;

two locating frames arranged in parallel on said machine base of said roller shape forming machine, said locating frames each comprising a vertical wall, two upper supports and two lower supports arranged on said vertical wall at different elevation, two first shafts respectively horizontally provided at said upper supports, and two second shafts respectively horizontally provided at said lower supports;

an upper mold holder holding a plurality of upper punching dies, said upper mold holder having two horizontal coupling holes and two vertical axle holes;

a lower mold holder holding a plurality of bottom punching dies corresponding to said upper punching dies, said lower mold holder having two horizontal coupling holes and two vertical axle holes;

four first bearing blocks respectively pivotally mounted on said first shafts at said upper supports, said first bearing blocks each having an eccentric rod respectively pivotally coupled to the horizontal coupling holes of said upper mold holder;

four first transmission gears respectively fixedly mounted around the periphery of said first bearing blocks;

four second bearing blocks respectively pivotally mounted on said second shafts at said lower supports, said second bearing blocks each having an eccentric rod respectively pivotally coupled to the horizontal coupling holes of said lower mold holder;

four second transmission gears respectively fixedly mounted around the periphery of said second bearing blocks and respectively meshed with said first transmission gears;

two guide axles respectively inserted through the vertical axle holes of said upper mold holder and the vertical axle holes of said lower mold holder;

a plurality of fastening members respectively fastened to said guide axles at top and bottom sides of the vertical axle holes of said upper mold holder to affix said guide axles to said upper mold holder;

two axle bearings respectively mounted in the vertical axle holes of said lower mold holder to support said guide axles in the vertical axle holes of said lower mold holder;

two first driven gears respectively meshed between said first transmission gears at the first bearing blocks at the vertical walls of said locating frames, said first driven gears each having a gear shaft respectively pivotally mounted on the vertical walls of said locating frames;

two second driven gears respectively meshed between the second transmission gears at the second bearing blocks at the vertical walls of said locating frames, said second driven gears each having a gear shaft respectively pivotally mounted on the vertical walls of said locating frames;

a drive gear set, said drive gear set comprising a gear shaft pivotally supported between the vertical walls of said locating frames, two drive gears respectively fixedly mounted on the gear shaft of said drive gear set and respectively meshed with the second transmission gears at the second bearing blocks at the vertical wall of one of said locating frames; and a motor coupled to the gear shaft of said drive gear set and adapted to rotate said drive gear set;

wherein said motor is controlled to rotate the drive gears of said drive gear set during operation of both the said roller shape forming machine and delivery of a metal sheet material through said roller shape forming machine, causing said second transmission gears to rotate said second driven gears and said first transmission gears and then said first driven gears, so that said first bearing blocks and said second bearing blocks are rotated and, and said upper mold holder and said lower mold holder are respectively forced by the eccentric rods said first bearing blocks the eccentric rods of said second bearing blocks to move alternatively forwards and backwards relative to each other and to punch said metal sheet material with said upper punching dies and said bottom punching dies, wherein the cycling of relatively forward and backward motion between said upper mold holder and said lower mold holder is set to machine the delivering speed of said metal sheet material through said roller shape forming machine, wherein said motor is controlled to punch the metal sheet material during a shape forming operation by the roller shape forming machine.

2. The punching machine as claimed in claim 1, wherein said punching machine is configured to be mounted to a base of the roller shape forming machine.

* * * * *